United States Patent [19]

Pundak

[11] Patent Number: 4,505,119

[45] Date of Patent: Mar. 19, 1985

[54] FLEXIBLE LINKAGE FOR THE DISPLACER ASSEMBLY IN CRYOGENIC COOLERS

[76] Inventor: Nachman Pundak, Ein Herod, Ihud, Israel

[21] Appl. No.: 512,411

[22] Filed: Jul. 8, 1983

[30] Foreign Application Priority Data

Dec. 9, 1982 [IL] Israel ..... 67441

[51] Int. Cl.[3] ..... F25B 9/00

[52] U.S. Cl. ..... 62/6; 92/256; 403/299

[58] Field of Search ..... 92/255, 256; 62/6; 403/299, 287, 343

[56] References Cited

U.S. PATENT DOCUMENTS

| | | | |
|---|---|---|---|
| 1,730,580 | 10/1929 | Lundgaard | 62/6 |
| 3,274,899 | 9/1966 | Stump | 92/255 |
| 3,552,120 | 1/1971 | Beale | 62/6 |
| 3,654,839 | 4/1972 | Thompson | 92/256 |
| 3,673,809 | 7/1972 | Bamberg | 62/6 |
| 3,906,739 | 9/1975 | Raimondi | 62/6 |
| 3,999,768 | 12/1976 | Jepson | 92/255 |
| 4,089,253 | 5/1978 | Visser | 92/255 |
| 4,090,859 | 5/1978 | Hanson | 62/6 |
| 4,172,676 | 10/1979 | De Chant | 403/287 |
| 4,206,609 | 6/1980 | Durenec | 62/6 |

*Primary Examiner*—Ronald C. Capossela

*Attorney, Agent, or Firm*—Toren, McGeady and Stanger

[57] ABSTRACT

In split cycle cryogenic coolers the compression and the expansion stage are distinct from one another and are connected by gas conduits. The change of volume of the expansion chamber is obtained by a linear, periodical movement of a displacer. According to the present invention, one end of a linkage connecting the displacer with its driving piston is directly connected to the latter while the other end of the linkage extends into the displacer. That end has a circumferential groove in which is seated an elastomeric ring.

2 Claims, 3 Drawing Figures

FLEXIBLE LINKAGE FOR THE DISPLACER ASSEMBLY IN CRYOGENIC COOLERS

FIELD OF INVENTION

The present invention relates to a flexible linkage for the displacer assembly of a the cold head in split cycle cryogenic cooler.

Cryogenic coolers are employed in a number of fields, e.g. electro-optics, electronics, vacuum techniques etc. They operate on a closed circuit such as Stirling, Solvay, Villumier etc. The construction of such coolers comprise two basic constituents: a compression unit—the displacer, and an expansion unit—the cold head.

There is well known a group of coolers being of split build, i.e. the compression—and the expansion stage being strictly distinct and being connected only by gas conducting conduits. In this type of coolers the operation of the expansion unit is by pneumatic means. In order to obtain the cooling function of the expansion unit, the creation of a proper phase differential between the column and pressure pulses (from the compression unit) and between the change of volume of the expansion cell is imperative, said change of volume is obtained by the linear periodical movement of the displacer.

PRIOR ART

There are known some methods for obtaining the said phase differential, some of which are based on friction, the source of which is either the dynamic seal or the use of viscous friction of the gas which passes through the regenerator.

The disadvantages of these methods reside in the wear and tear of the seal and the loss of the cooling potential in the regenerator due to the pressure damping of the gas therein (said disadvantages have been explained in detail in my co-pending patent application Ser. No. 495,429, filed May 17, 1983).

Other methods for controlling the phase differential are based on the passive control of the motion of the displacer by means of a magnetic or pneumatic damper (first kind) or by means of pneumatic drive with a resonantic motion control (second kind).

In cold heads of the first kind there is an advantage in employing the use of the gap type seals.

In cold heads with a pneumatic drive with a pneumatic pillow the displacer assembly must have two packing seals in line, the one separates the pneumatic pillow from the front of the cold head while the second separates the cold cylinder from the displacer, its function is to force the gas to flow to the expansion cell through the regenerator. In case the said two packings (seals) are of the gap type the requirements of the straightness, evenness and concentricity of the displacer assembly are very high, their standards are very difficult to achieve, on the other hand leaving a radial gap between the displacer and the cylinder to compensate the unevenness or unstraightness will affect the efficiency of the cold head.

OBJECT OF THE INVENTION

It is the object of the present invention to provide a flexible linkage between the displacer and the displacer's driving piston to overcome the aforesaid problem and disadvantages.

SHORT SUMMARY OF DISCLOSURE

According to the invention there is provided a linkage for the connection of the displacer with its driving piston, one end of which linkage being connected to the displacer driving piston while its other end penetrates into the displacer, said penetrating portion being provided with a circumferential groove in which is seated an elastomeric ring.

The said ring fulfils a double function: it constitutes an elastic connecting means and forces the flow of gas into a predetermined path.

Due to the fact that the connection between the displacer and the displacer driving piston is via and by means of the elastic ring the following is achieved:

1. Obtaining flexibility between the displacer driving piston and the displacer, a matter which overcomes the difficulty of attaining the straightness required.

2. Obtaining adaptability to a certain degree for overcoming the problem of concentricity between said two parts.

3. Safeguarding the impermeability of the linkage so that the gas which flows through it will flow through the regenerator and not bypass the regenerator by flowing along the cylinder.

SHORT DESCRIPTION OF DRAWINGS

The invention will now be described in detail with reference to the annexed drawing, in which FIG. 1 is a schematical view of the displacer assembly, while FIG. 2 shows the displacer driving piston and the displacer, removed from the assembly, and FIG. 3 is an enlarged detail, partly in section, of a portion of the elements illustrated in FIG. 2.

DETAILED DESCRIPTION OF PREFERRED EMBODIMENT

Figure 1:
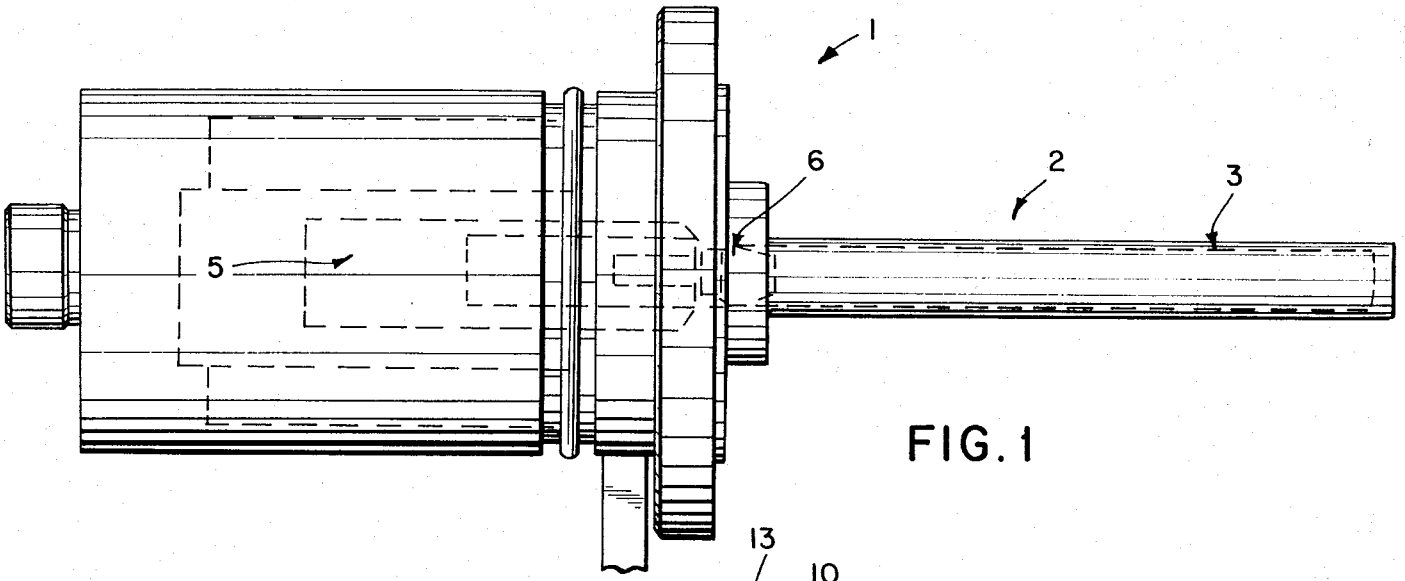
Figure 2:
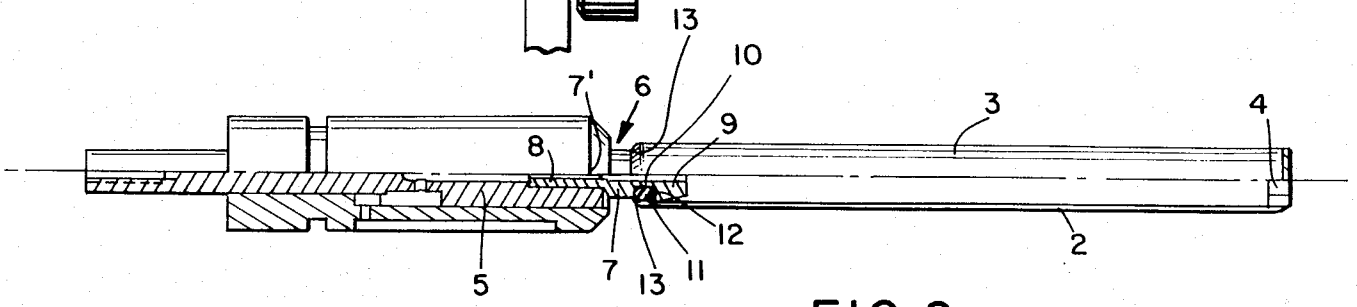
Figure 3:
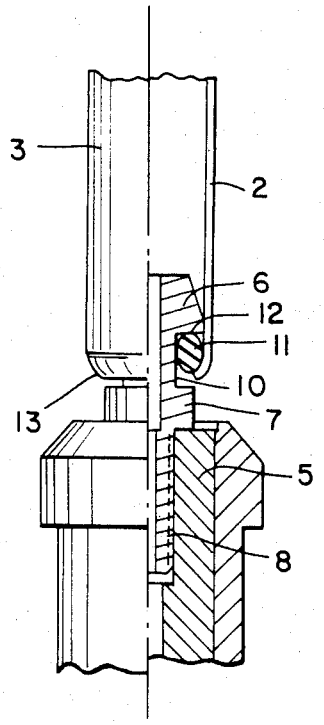

The cold head 1 constitutes the following elements: a displacer 2, a regenerator 3, an expansion chamber 4 and a displacer driving piston 5. The flexible linkage 6 comprises member 7, one end of which 8 is screwed into said driving piston 5, the other end 9 penetrates into the displacer 2. In member 7 extend a bore 7' ensuring two directional (to and fro) flow of gas. Said member is provided with a circumferential groove 10, into said groove an elastomeric ring 11 is placed, said ring rests on shoulder 12 of the groove while at its opposite side it is held by the displacer the lip of which is bent slightly inwardly at 13. It can be seen that member 7 is held in position by means of the ring on one side and the displacer on the other.

By employing the flexible linkage the following advantages are achieved:

1. It enables to reduce the radial gap between the cold cylinder and the displacer, a matter which increases the cooling capacity of the cold head.

2. The assembly, the dismantling and adjustment of the displacer assembly and its ease prevents the failures of the movement of the displacer.

I claim:

1. A split cycle cryogenic cooler comprising an axially elongated displacer having a first end and a second end, an axially extending driving piston driving said displacer, said driving piston being in substantially axial alignment with and spaced axially from said displacer, said driving piston having a first end adjacent and spaced from the second end of said displacer and a second end more remote from the second end of said displacer, a linkage member forming a flexible connection between the first end of said driving piston and the second end of said displacer, said linkage member being in general axial alignment with said displacer and driving piston and having a first end connected into the second end of said displacer and a second end connected to the first end of said driving piston, said second end of said displacer forms an axially extending bore having a circumferential surface and said first end of said linkage member extends into said bore and has a circumferential groove therein in spaced facing relation with the circumferential surface of said bore, and an elastomeric ring seated within said groove and extending radially outwardly into sealing contact with the circumferential surface of said bore and permitting flexible angular and concentric misalignment between said displacer and said driving piston while maintaining said linkage member gas-tight for eliminating any gas bypass around said displacer.

2. A split cycle cryogenic cooler, as set forth in claim 1, wherein the first end of said driving piston has a threaded bore therein, the second end of said linkage member being in threaded engagement with said bore in said driving piston, the second end of said displacer at the opening into said bore being bent inwardly for securing said elastomeric ring in the space between said groove in said linkage member and the circumferential surface in said bore in said displacer.

* * * * *